US005111852A

United States Patent [19]

Verhulst

[11] Patent Number: 5,111,852

[45] Date of Patent: May 12, 1992

[54] WEFT INSERTING NOZZLE WITH SEPARATE THREADING DUCT

[75] Inventor: Jozef Verhulst, Zillebeke, Belgium

[73] Assignee: Picanol N.V., Belgium

[21] Appl. No.: 581,308

[22] Filed: Sep. 13, 1990

[30] Foreign Application Priority Data

Sep. 19, 1989 [BE] Belgium ..... 8901006

[51] Int. Cl.[5] ..... D03D 47/34

[52] U.S. Cl. ..... 139/435.4; 28/272; 57/279; 226/91

[58] Field of Search ..... 139/450, 435.4, 435.1; 28/203, 272; 57/279; 226/91; 242/35.6

[56] References Cited

U.S. PATENT DOCUMENTS

| | | | |
|---|---|---|---|
| 3,451,437 | 6/1969 | van Mullekom . | |
| 4,542,772 | 9/1985 | Gasshutz | 139/435.4 |
| 4,550,752 | 11/1985 | Manders | 139/435.4 |
| 4,649,965 | 3/1987 | Wenig et al. | 139/450 X |
| 4,724,588 | 2/1988 | Runkel | 28/272 |
| 4,969,489 | 11/1990 | Tanaka et al. | 139/450 |

FOREIGN PATENT DOCUMENTS

| | | | |
|---|---|---|---|
| 63-39700 | 9/1982 | Japan | 139/435.4 |

*Primary Examiner*—Andrew M. Falik
*Attorney, Agent, or Firm*—Bacon & Thomas

[57] ABSTRACT

A blow device for weft threads in weaving machines, in particular a blow device which makes use of a nozzle of the type which consists of a housing, a thread guide duct extending through the housing and a first or main blower situated in the housing and working with the thread guide duct to transport a weft thread to the shed of the weaving machine. The nozzle has a second or threading blower also situated in the housing that cooperates with the thread guide duct for threading the nozzle. The second blower has at least one blow duct which intersects the thread guide duct at an angle so as to thrust a weft thread presented at the entry of the thread guide duct through the thread guide duct when supplied with air. A central system deactivates the main blower when the threading blower is activated.

13 Claims, 4 Drawing Sheets

WEFT INSERTING NOZZLE WITH SEPARATE THREADING DUCT

BACKGROUND OF THE INVENTION

The present invention concerns a blow device for weft threads in weaving machines. In particular, it concerns a blow device which makes use of a nozzle of the type which consists of a housing, a thread guide duct stretching out through the housing, and blowing means working with the thread guide duct to transport the weft thread. By blowing means are primarily meant the main nozzles of an airjet weaving machine. The invention can also be used, however, for auxiliary main nozzles.

It is known that the main nozzles of airjet weaving machines are provided with compressed air via valves which are controlled by means of a control unit and which are opened at particular moments in the weaving cycle, in particular during the insertion of the weft threads. In the intermediate periods, a weak air flow is continuously supplied via a throttle valve so that the weft threads can be kept in the main nozzles by their ends. When the weaver has to make a threading, only this weak air flow is produced. Only very little suction force is created in this case, which makes the threading rather difficult.

Another well-known method to thread such a main nozzle is to switch on the main nozzles at full power, for example by means of a push button which transmits a signal to the aforesaid control unit, as a result of which the main nozzle in question operates at full capacity for a certain period. Given the big air flow and the blow direction, the suction force at the entry of the nozzle is also weak in this case. Moreover, this method is disadvantageous in that the thread end which has been sucked up by the strong air flow exerted upon it is entirely unravelled.

The present invention concerns a blow device for weft threads in weaving machines, in particular a blow device which makes use of the aforesaid type of nozzles, which does not have the above-mentioned disadvantages.

To this end, it is made up of a blow device for weft threads in weaving machines, in particular a blow device which makes use of a nozzle of the type which consists of a housing, a thread guide duct stretching out through the housing, and first blowing means situated in the housing and working with the thread guide duct to transport the weft thread to the shed, characterized in that the nozzle has second blowing means, also situated in the housing and working with the thread guide duct, to thread the nozzle, whose second blowing means are made up of at least one blow duct which ends at an angle in the thread guide duct, which makes it possible to thrust a weft thread presented at the entry of the thread guide duct through the thread guide duct.

These second blowing means preferably have exactly one blow duct which ends at an angle in the thread guide duct and whose section and said angle are selected such that, on the one hand, the thrust force is sufficiently strong for the threading, but on the other hand not sufficiently strong to unravel the weft thread.

The blow device according to the invention is also provided with means which allow the second blowing means to be easily switched on and off.

According to a preferred embodiment, these means consist of a compressed air junction provided with a manually operated valve which has been built into the housing of the nozzle, such that a very compact construction is obtained.

According to a variant, use is made of an electromagnetic valve operated by means of a push button, such that when it is energized, said valve is opened and the above-mentioned second blowing means are activated, and such that, also by means of appropriate valves, the air supply to the first blowing means which transport the weft thread are closed off completely.

BRIEF DESCRIPTION OF THE DRAWINGS

In order to better explain the characteristics of the invention, by way of example only and without being limitative in any way, the following preferred embodiments are described with reference to the accompanying drawings where.

DETAILED DESCRIPTION OF THE PREFERRED EMBODIMENT

Figure 1:
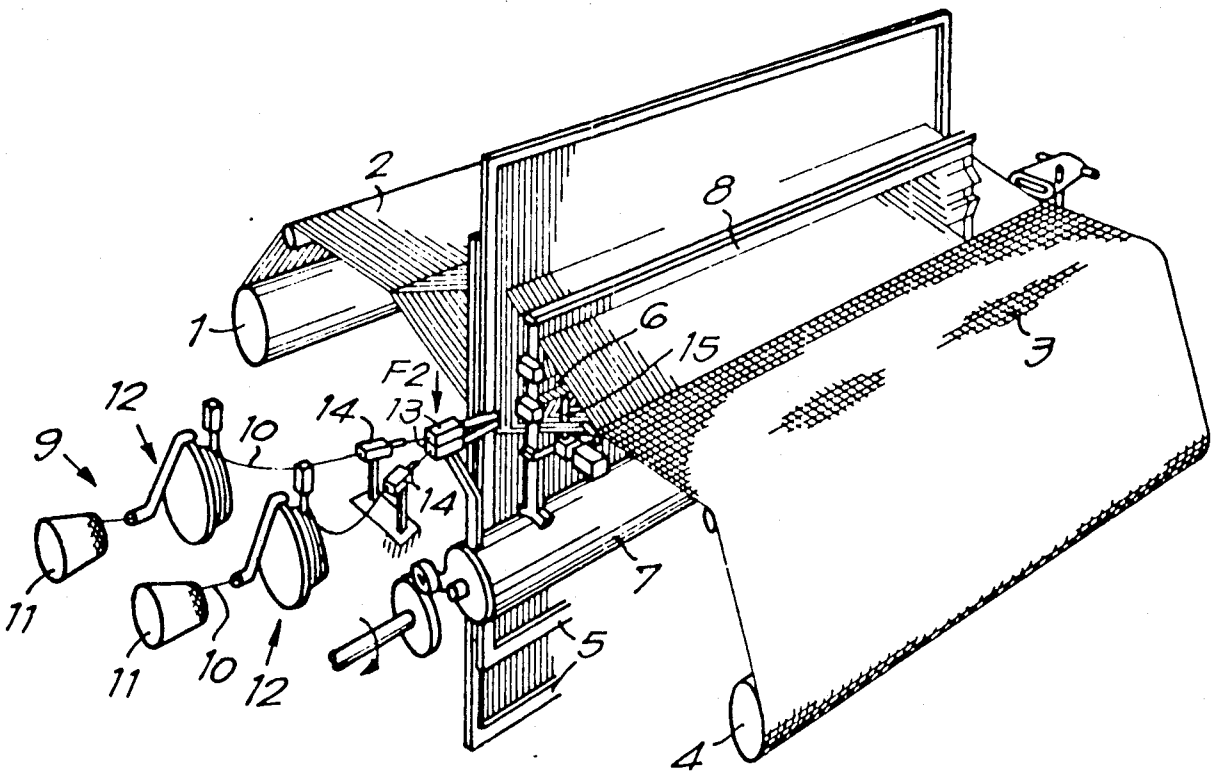
FIG. 1 is a schematic representation of a blow device according to the invention and of its position in a weaving machine.

In order to illustrate the invention, FIG. 1 shows a schematic representation of a weaving machine in which the main parts have been indicated. These elements consist, as is known, of a warp beam 1, the warp 2, the cloth formed 3, the cloth roll 4, the harnesses 5 to form the shed 6, the sley 7 with the reed 8 and weft thread supply means 9 which allow for one or more weft threads 10 to be inserted in the shed 6 per weaving cycle.

These weft thread supply means 9 are made up of feed bobbins 11, yarn storage feeders 12 and a number of blow devices consisting of at least one main nozzle 13 and possibly one or more auxiliary main nozzles 14 and relay nozzles 15.

The present invention concerns a blow device which makes it possible for the nozzles through which the weft threads 10 are transported, in the first place the main nozzles 13, but also the auxiliary main nozzles 14 and possibly also other nozzles of the same type, to be threaded easily and in a short time without any damage being done to the weft thread 10.

Figure 2:
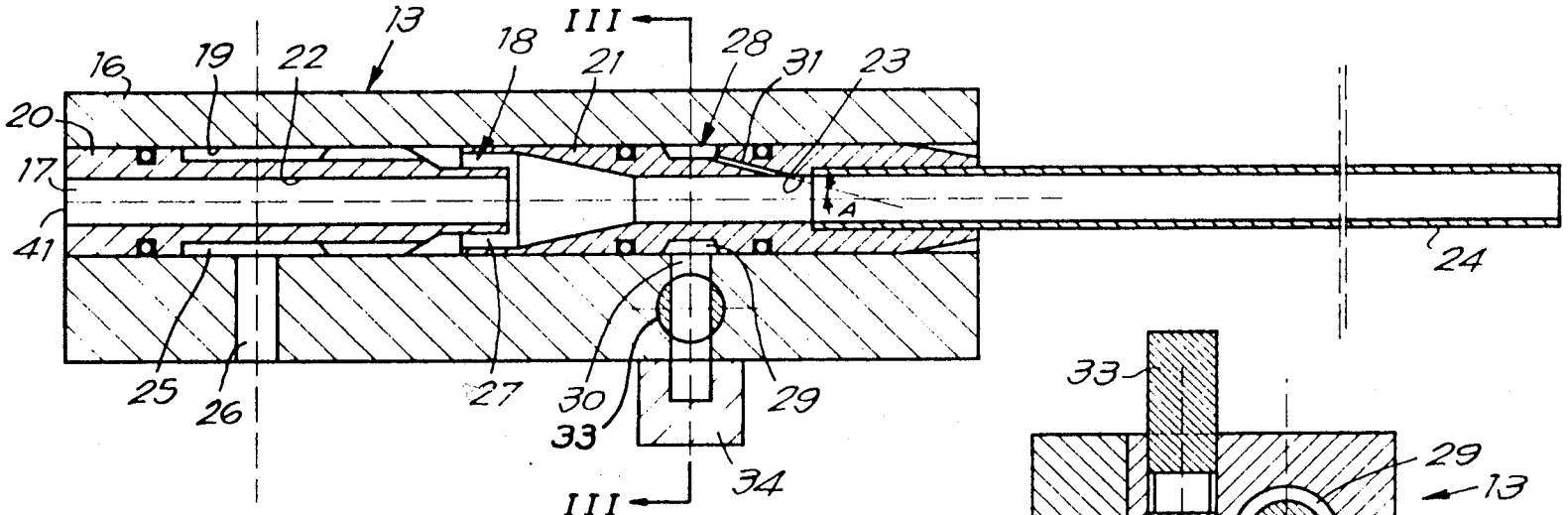
FIG. 2 shows a section of that part, in particular the main nozzle, which is indicated in FIG. 1 with F2.
Figure 3:
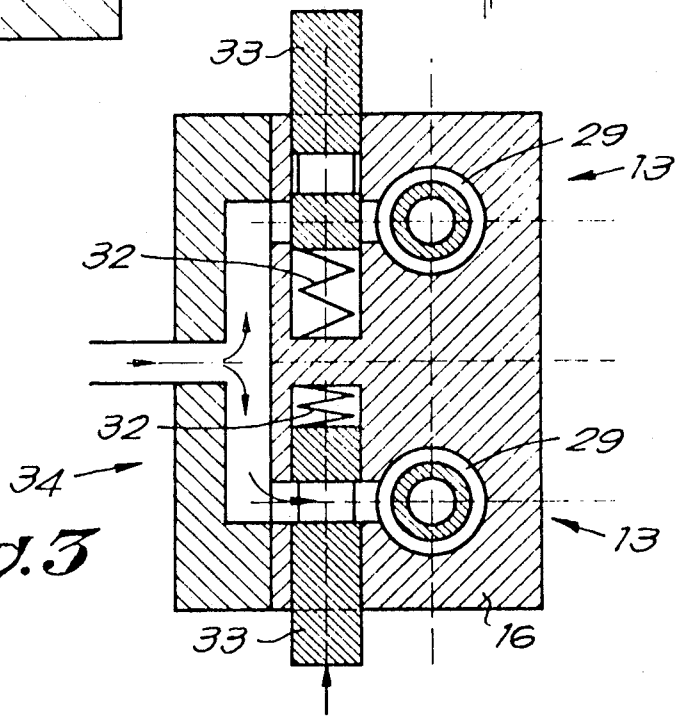
FIG. 3 shows a section according to line III—III in FIG. 2, representing a double main nozzle.
Figure 4:
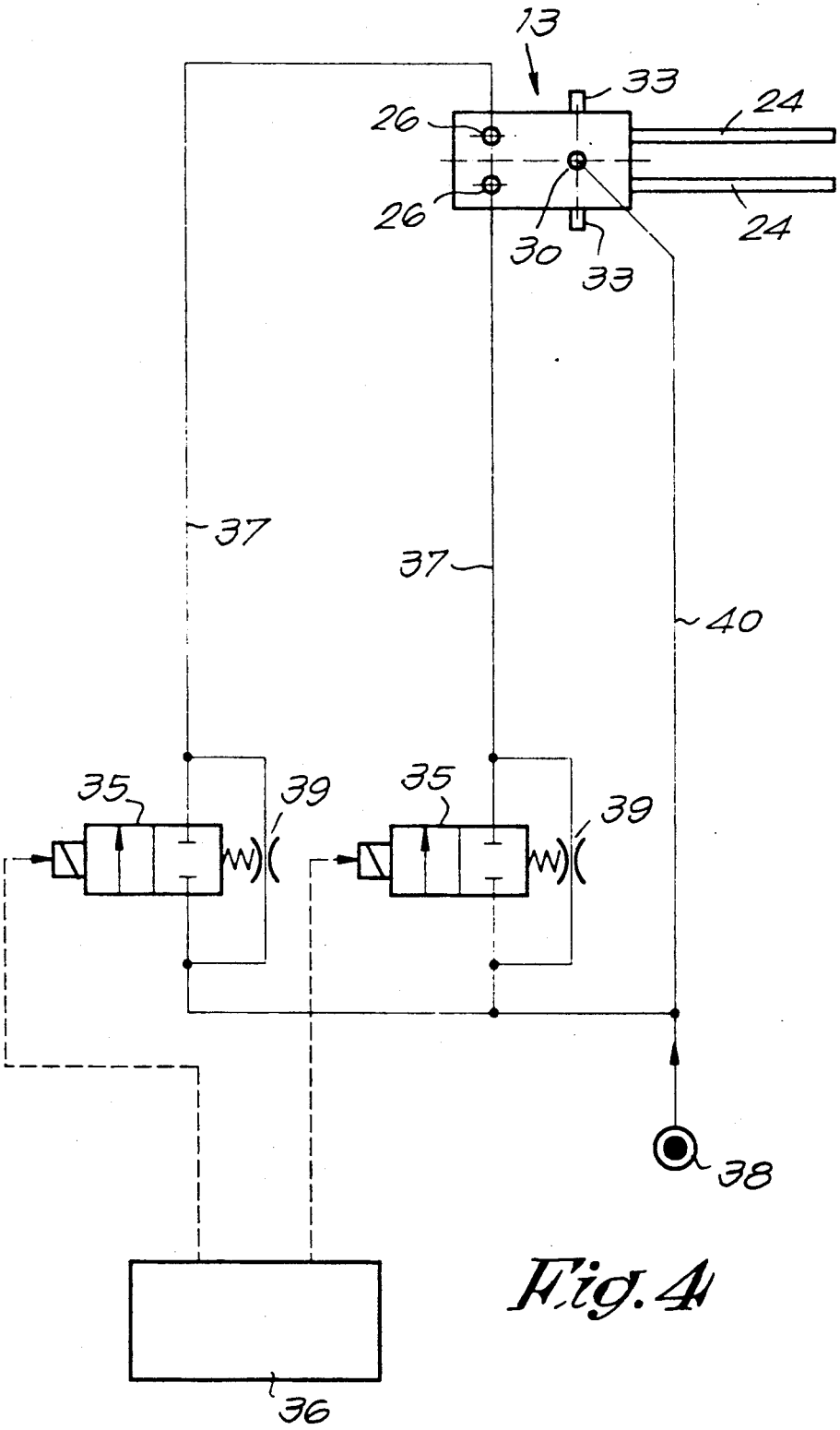
FIG. 4 shows how the blow device in FIG. 3 can be provided with compressed air.

FIGS. 2 to 4 show an example which concerns the main nozzles 13 according to the invention. As shown in FIG. 2, this main nozzle 13 mainly consists of a housing 16, a thread guide duct 17 stretching out through the housing 16, and first blowing means 18 working with the thread guide duct 17 to transport the weft thread 10. The main nozzle 13 has a bore hole 19, in which two thread guide duct sections or elements 20 and 21 have been mounted axially and which each have axial bore holes 22 and 23 as well, forming the above-mentioned thread guide duct 17. A thread guide pipe 24 or jet pipe has been mounted in the downstream end of the second element 21. The above-mentioned first blowing means 18 to transport the weft thread consist, as is known, of a space 25 situated around the first element 20, in which an air supply duct 26 ends, and a space or passage 27 between the exit end of the first element 20 and the entry end of the second element 21, which connects the space 25 with the thread guide duct 17, such that the supplied air is thrusted in the direction of the thread guide pipe 24.

The blow device according to the invention is special in that the nozzle, in this case the main nozzle 13, is specially fitted with second blowing means 28 working with the thread guide duct 17 to thread the nozzle. In the embodiment according to FIG. 2, these blowing means 28 are made up of a chamber 29, situated around the second element 21, formed for example by a recess in this element 21, in which an air supply duct 30 ends, and at least one blow duct 31 ending in the thread guide duct 17 at an angle A, which is connected with the chamber 29 and which allows an air current to be created in the direction of the thread guide pipe 24. Although several blow ducts 31 can be applied, it is preferred to provide only one blow duct 31. If several blow ducts 31 are used, it is possible that in certain cases the various outgoing air jets do not exactly converge in one point, which may cause the weft threads 10 to unravel.

Preferably, the blow device according to the invention is also provided with means to switch on the second blowing means 28 during the threading.

Therefore, in the embodiments according to FIGS. 2 and 3, use is made of manually operated valves 33 which can be released by means of springs 32 and which have been mounted in the air supply ducts 30 of the respective main nozzles 13, whereby a free passage is created as these valves 33 are pressed. These valves 33, as shown in FIGS. 2 and 3, are preferably built into the nozzles, in particular in the above-mentioned housing 16, which results in a very compact construction as very little recess space is required for the mounting.

In case of a double blow device, made up for example of two main nozzles 13 mounted one on top of the other as shown in FIG. 3, the above-mentioned construction with the manually operated valves 33 is advantageous in that one joint compressed air junction 34 can be provided for both blowing means 28 of the respective main nozzles 13.

The different air supply ducts 26 and 30 can be connected as shown in FIG. 4. The blowing means 18 are in this case operated in the conventional manner by means of electromagnetically controlled valves 35, which are controlled for example by means of the control unit 36 of the weaving machine. In rest position, these valves 35 interrupt the supply ducts 37 between the compressed air source 38 and the air supply ducts 26, whereby, still, a constant, weak air flow, is provided via the throttle or bypass bleed valves 39 as mentioned above. The air supply ducts 30 of the second blowing means 28 are coupled directly to the compressed air source 38 via a supply duct 40, such that the threading pressure is practically equal to the weaving pressure.

The diameter of the blow duct 31 via which the air is directed into the thread guide duct 17 is selected such, however, that the suction force at the entry 41 of the thread guide duct 17 is sufficiently strong to suck in a weft thread, but not sufficiently strong to cause said weft thread to be unravelled or damaged. Therefore, the blow duct 31 has a diameter of 0.3 to 0.8 mm and stands at an angle A of 15 to 45 degrees towards the thread guide duct 17.

If a weaving pressure of for example five bar is used, and if a conventional main nozzle 13 with a thread guide duct 17 having a diameter of 3 mm is used, the blow duct 31 preferably has a diameter of 0.5 mm and is to stand at an angle A of preferably 30 degrees to the thread guide duct 17.

The fact that the blow ducts 31 have small diameters offers the advantage that a single supply pressure suffices, which is preferably equal to the weaving pressure, such that no separate throttle valve or similar has to be provided. Given the small diameter of the blow ducts, the consumption of air is limited as well.

The above-mentioned second blowing means 28 also offers the advantage that they can be manufactured at low cost and that they can be easily mounted in the housing 16 of the main nozzle 13.

The working of the blow device can be easily derived from FIGS. 2 to 4. In rest position, the first blowing means 18 are provided with a weak air flow via the throttle valves 39. During the insertion of a weft thread 10, a strong air flow is provided in the first blowing means 18 by energizing the valves 35. During the threading, the valve 33 in question is pressed manually and the weft thread 10 is presented at the entry 17, as a result of which it is sucked in under the best possible conditions. It is clear that for the threading, the blow device has to be in said rest position.

Figure 5:
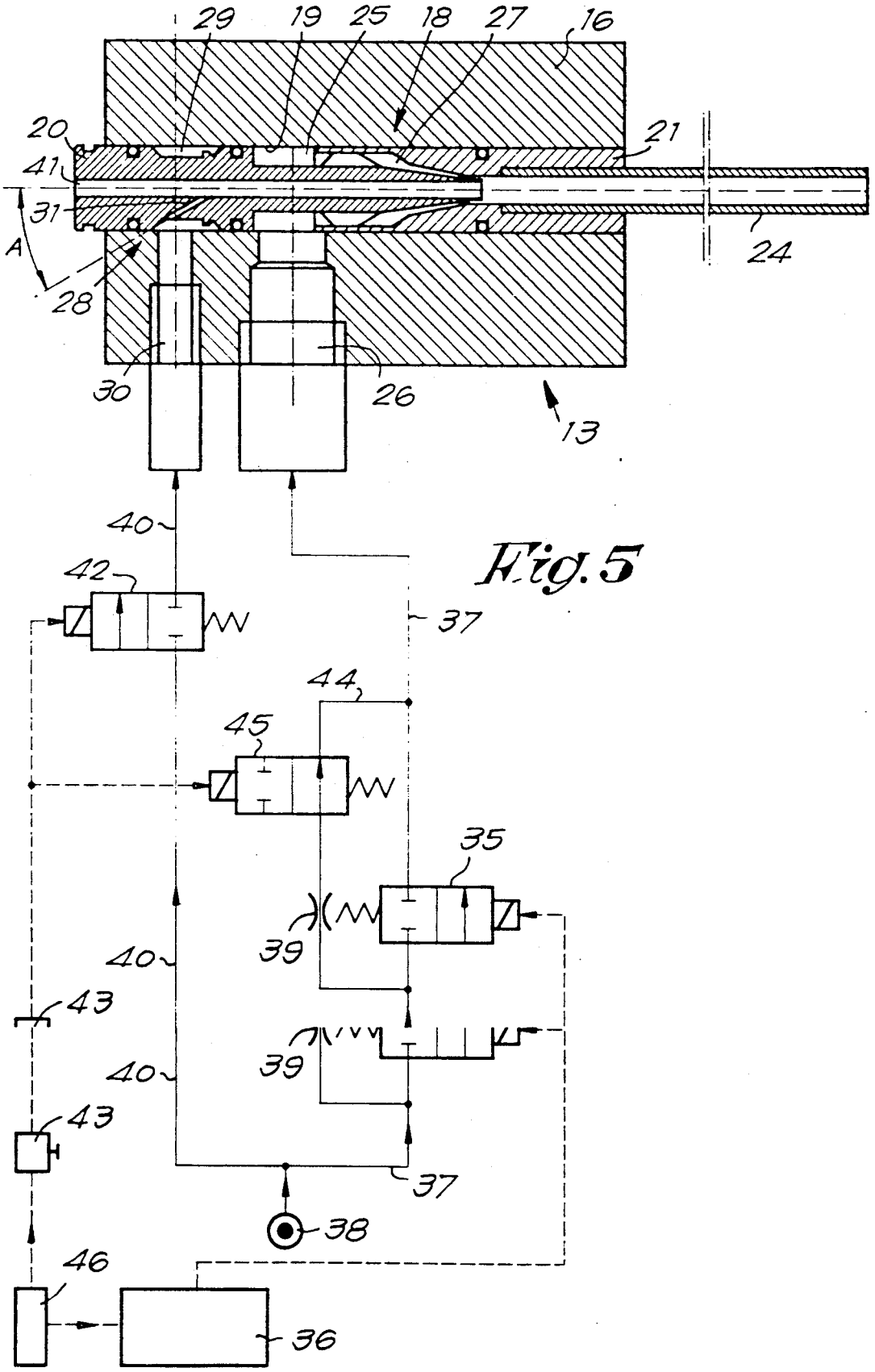
FIG. 5 shows another blow device according to the invention.

FIG. 5 shows a variant of the blow device according to the invention. The main nozzle 13 is different from that in FIG. 2 in that the blow duct 31 is now situated in the first element 20, and so upstream of the first blowing means 18, and as a result also closer to the entry 41, such that apart from a sucking action a blowing action is also exerted on the weft thread presented at the entry 41, which makes the threading easier.

In the embodiment shown in FIG. 5, the means to switch on the second blowing means 28 consist of an electromagnetically controlled valve 42 placed in the supply duct 40, which obstructs the supply duct 40 in rest position, and connects the air supply duct 30 with the compressed air source 38 in its activated position. Energization is done by pressing a push button 43.

Tests have pointed out that the thrust force at the entry 41 is even reinforced when the weak air flow via the above-mentioned throttle valve 39 is shut off during the threading. According to the invention, the blow device is preferably provided with deactivating means which entirely disconnect the first blowing means 18 when the second blowing means 28 are energized. According to FIG. 5, this is possible because, as the push button 43 is pressed, a cutoff valve is also provided in the duct 44 which passes along the throttle valve 39, for example an electromagnetically controlled valve 45. The whole is coupled to an electric power supply 46.

It is clear that the electromagnetically controlled valve 45 does not necessarily have to applied at the height of the duct 44. The electromagnetic valve may also be applied at the height of the supply duct 37 of the air supply duct 26. This embodiment offers the advantage that the first blowing means 18 are disconnected with certainty, yet it required a valve 45 which provides a greater passage for the compressed air.

The push button control by means of a push button 43 can be conceived such that the valve 42 and possibly also the valve 45 are only energized as long as the push button 43 is pressed. According to a variant, a connection or control whereby, after the push button 43 has been pressed, the second blowing means 28 remain switched on for a certain period, for example a few seconds, can also be applied. It is clear that the manually operated valve 33 can also be applied to the main nozzle 13 in FIG. 5, whereas the pneumatic connection in FIG. 5 can be used with the main nozzle 13 in FIG. 2. Moreover, other connections can also be used to switch on the second blowing means 28.

It is clear that the embodiments in FIGS. 2 to 5 can also be applied to auxiliary main nozzles 14. The connection of the different air supply ducts 26 and 30 of an auxiliary main nozzle 14 can be made analogous to that of the above-mentioned main nozzle 13. During the threading of the main nozzle 13, all auxiliary main nozzles 14 are preferably switched off so that the air flow coming from the auxiliary main nozzles 14 does not impeded the threading of the main nozzle 13. To this end, either no throttle valve 39 is to be provided in the supply duct of the auxiliary main nozzles 14, or all electromagnetic valves 45 belonging to the auxiliary main nozzles 14 are to be energized during the threading of the main nozzle 13, in an analogous manner to that in FIG. 5.

The present invention is in no way limited to the embodiments described by way of example and shown in the accompanying drawings; on the contrary, such a blow device for weft threads in weaving machines can be made in various forms and dimensions while still remaining within the scope of the invention.

I claim:

1. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; means for actuating the second blowing means during a threading of the nozzle; and an air supply duct for supplying air to the second blowing means; and wherein the means for actuating the second blowing means during the threading of the nozzle comprises a normally closed manually operable air flow control valve for controlling flow of compressed air through the duct and said second blowing means.

2. The improvement according to claim 1, wherein said valve is mounted on said housing.

3. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; means for actuating the second blowing means during a threading of the nozzle; an air supply duct for supplying air to the second blowing means; and wherein the means for actuating the second blowing means during the threading of the nozzle comprises a normally closed electromagnetically actuated valve for controlling flow of compressed air through the duct and said second blowing means.

4. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; and means for deactivating the first blowing means while the second blowing means is activated; first and second air supply ducts for supplying air to said first and second blowing means, respectively; first and second air control valve means for controlling flow of compressed air in said first and second air ducts, respectively; a control unit for controlling the air control valve means; a bypass bleed line for feeding bleed air around the first air control valve means when the latter is closed; said means for deactivating the first blowing means including a third air control valve means for controlling flow of bleed air to the first blowing means; said control unit including means for activating said first and third air control valve means so that the third air control valve means is actuated to cut off the flow of bleed air to the first blowing means when the second air control valve means is actuated to supply compressed air to said second blowing means.

5. The improvement in a blow device according to claim 4, wherein said third air flow control valve is disposed in said bypass bleed line.

6. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; said housing including a bore, and wherein said thread guide duct comprises first and second thread guide duct sections axially disposed in said bore, said first thread guide duct section having an entry end disposed at the thread entry end of the nozzle and having an opposed exit end portion disposed in radially spaced relationship relative to said bore; said second thread guide duct section comprising said second blowing means and having an entry end portion disposed in radially spaced relationship with a part of said exit end portion of said first thread guide duct section; the space between said exit end portion of said first thread guide duct section and the bore and the space between said exit end of the first thread guide duct section and the entry end portion of the second thread duct guide section comprising said first blowing means.

7. The improvement in a blow device as claimed in claim 6, including an air supply duct in communication with the space between the exit end portion of the first thread guide duct section and the bore for supplying air to the first blower means.

8. The improvement in a blow device according to claim 6, wherein said second blowing means consists of a single blow duct.

9. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; said housing including a bore and wherein said thread guide duct comprises first and second thread guide duct sections axially disposed in said bore, said second thread guide duct section comprising said second blowing means and having an entry end disposed at the thread entry end of the nozzle and an opposed exit end portion disposed in radially spaced relationship with the bore; said first guide duct section having an entry end portion disposed in radially spaced relationship with part of said exit end portion of the second thread guide duct section, the space between said exit end portion of the first thread guide duct section and the bore and the space between said exit end of the first thread guide duct section and the entry end of the second thread guide duct section comprising said first blowing means.

10. The improvement in a blow device according to claim 9, including an air supply duct in communication with the space between the exit end of the second thread guide duct section and said bore for supplying air to said first blowing means.

11. The improvement in a blow device according to claim 9, wherein said second blowing means consists of a single blow duct.

12. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; means for actuating the second blowing means during a threading of the nozzle; and an air supply duct for supplying air to the second blowing means; and wherein the means for actuating the second blowing means during the threading of the nozzle comprises a normally closed manually operable air flow control valve for controlling flow of compressed air through the duct and said second blowing means; and means for deactivating the first blowing means while the second blowing means is activated.

13. In a blow device for weft threads in weaving machines including a nozzle comprising a thread guide duct extending through a housing and first blowing means disposed in the housing and cooperating with the thread guide duct to transport a weft thread through the duct to a shed of the weaving machine, the improvement comprising, said nozzle including a second blowing means also disposed in the housing and cooperating with the thread guide duct to thread the nozzle, said second blowing means including at least one blow duct intersecting the thread guide duct at an angle (A) arranged to cause the leading end of a weft thread presented at the entry of the thread guide duct to be thrust through the thread guide duct; means for actuating the second blowing means during a threading of the nozzle; an air supply duct for supplying air to the second blowing means; and wherein the means for actuating the second blowing means during the threading of the nozzle comprises a normally closed electromagnetically actuated valve for controlling flow of compressed air through the duct and said second blowing means; first and second air supply ducts for supplying air to said first and second blowing means respectively; first and second air control valve means for controlling flow of compressed air in said first and second air ducts, respectively; a control unit for controlling the air control valve means; a bypass bleed line for feeding bleed air around the first air control valve means when the latter is closed; said means for deactivating the first blowing means including a third air control valve means for controlling flow of bleed air to the first blowing means; said control unit including means for activating said first and third air control valve means to that the third air control valve means is actuated to cut off the flow of bleed air to the first blowing means when the second air control valve means is actuated to supply compressed air to said second blowing means.

* * * * *